US012297609B2

(12) United States Patent
Huber et al.

(10) Patent No.: US 12,297,609 B2
(45) **Date of Patent: *May 13, 2025**

(54) FORMWORK SYSTEM AND METHOD

(71) Applicant: PERI SE, Weissenhorn (DE)

(72) Inventors: Julian Huber, Merklingen (DE); Andrew Read, Voehringen (DE); Florian Sturm, Unterroth (DE); Ken Harris, Elkridge, MD (US); Justin Lunday, Elkridge, MD (US); Dan Straub, Elkridge, MD (US)

(73) Assignee: PERI SE, Weissenhorn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/392,704

(22) Filed: Dec. 21, 2023

(65) Prior Publication Data

US 2024/0279889 A1 Aug. 22, 2024

Related U.S. Application Data

(63) Continuation of application No. 18/049,169, filed on Oct. 24, 2022, now Pat. No. 11,885,083, which is a continuation of application No. 16/988,555, filed on Aug. 7, 2020, now Pat. No. 11,479,929.

(51) Int. Cl.

| | |
|---|---|
| ***E01D 19/02*** | (2006.01) |
| ***E01D 21/00*** | (2006.01) |
| ***E01D 22/00*** | (2006.01) |
| *E01D 101/26* | (2006.01) |

(52) U.S. Cl.

CPC ..... *E01D 22/00* (2013.01); *E01D 19/02* (2013.01); *E01D 21/00* (2013.01); *E01D 2101/26* (2013.01)

(58) Field of Classification Search

CPC ..... E01D 19/02; E01D 21/00; E01D 22/00; E01D 2101/126

USPC ..... 14/77.3

See application file for complete search history.

(56) References Cited

U.S. PATENT DOCUMENTS

| | | | |
|---|---|---|---|
| 3,565,400 | A | 2/1971 | Ietoshi |
| 3,593,392 | A | 7/1971 | Lambertini |
| 3,985,480 | A | 10/1976 | Finsterwalder |
| 4,873,738 | A | 10/1989 | Shook |
| 5,444,957 | A | 8/1995 | Roberts |
| 5,782,043 | A | 7/1998 | Duncan |
| 11,479,929 | B2 | 10/2022 | Huber |
| 2002/0011045 | A1 | 1/2002 | Hambelton |
| 2012/0279000 | A1 | 11/2012 | Kim |
| 2013/0020732 | A1 | 1/2013 | Jentsch |
| 2013/0283726 | A1 | 10/2013 | Chaput |

FOREIGN PATENT DOCUMENTS

| | | |
|---|---|---|
| JP | S6370773 | 3/1988 |
| RU | 2029841 | 2/1995 |
| RU | 2038975 | 7/1995 |
| RU | 2138606 | 9/1999 |

*Primary Examiner* — Raymond W Addie

(74) *Attorney, Agent, or Firm* — SLEMAN & LUND LLP

(57) ABSTRACT

A formwork system, including a plurality of side formwork elements configured to confront a concrete structure, a horizontal formwork panel configured to support the concrete structure, and at least one working platform, wherein the system is configured to be split in a longitudinal direction and stricken or cycled from the concrete structure in two discrete parts.

19 Claims, 12 Drawing Sheets

FORMWORK SYSTEM AND METHOD

RELATED APPLICATIONS

The present application is related to commonly assigned U.S. patent application Ser. No. 16/988,483, entitled FORMWORK SYSTEM AND METHOD, by Huber et al., filed on Aug. 7, 2020, commonly assigned U.S. patent application Ser. No. 16/988,492, entitled STRIKING TOOL AND METHOD, by Huber et al., filed on Aug. 7, 2020, commonly assigned U.S. patent application Ser. No. 16/988,538, entitled MULTI-HEAD BOLT AND FASTENER SYSTEM, by Huber et al., filed on Aug. 7, 2020, the teachings of each of which are expressly incorporated herein by reference.

FIELD OF THE INVENTION

The invention relates to formwork systems for forming bridge pier caps on a bridge pier and methods of cycling the formwork systems.

BACKGROUND OF THE INVENTION

In constructing bridge pier caps, formwork systems are typically used to form the bridge pier cap. Such systems include dancefloor applications or self-spanning formwork. In operation, such formwork systems are constructed with respect to a bridge pier to allow for formation of the bridge pier cap. Once the bridge pier cap is formed, the formwork systems are removed (also referred to as striking) and moved to a different position at the site to form additional bridge pier caps (also referred to as cycling).

In dancefloor applications, to strike the form the upper side form will simply be lifted up, but the "dancefloor" needs to be lowered to the ground and dismantled piece by piece. To strike the form the upper side form will simply be lifted up, but the "dancefloor" needs to be lowered to the ground and dismantled piece by piece.

In self-spanning applications, to set the formwork the whole assembled unit is transported by a crane and placed on the installed jacks. The reinforcement is brought in afterwards, so workers have to climb into the form to do the final reinforcement work. To strike the form they split it at one of the bottom joints while the formwork is hanging on the crane. Therefore, workers have to access that joints with a manlift.

SUMMARY OF THE INVENTION

The present application overcomes the disadvantages of the prior art by providing a formwork system that can be split into two or more discrete parts for safer, easier, and faster cycling on a job site without the need to disassemble the entire platform. In this regard, the formwork system provides easy and fast striking, requires less assembly and disassembly time, reduces connections, provides safe access for reinforcement works, requires less manlift time, and provides crane independent striking.

Advantageously, the present application provides the ability to strike the system in fewer crane lifts, for example exactly two (or in other examples greater than two) crane lifts. The platform can be split in a longitudinal direction in two parts and the two discrete parts can be lifted by crane without requiring complete disassembly of the panels or connections to cycle.

One aspect of the disclosure provides a formwork system, comprising: at least one horizontal formwork element configured to support a concrete structure; a plurality of connection beams, at least one of the connection beams being releasably connected to the horizontal formwork element such that the formwork system is configured to split in a longitudinal direction and stricken or cycled from the concrete structure in two or more discrete parts.

In one example, the system further comprises a plurality of main beams configured to support the at least one horizontal formwork element and the respective plurality of connection beams.

In one example, at least one of the main beams is releasably connected to at least one connection beam.

In one example, the system further comprises a plurality of jacks fixed to a bridge pier configured to a least partially support the plurality of main beams.

In one example, the plurality of jacks, upon actuation, cause respective vertical displacement of the plurality of main beams.

In one example, actuation is caused at least in part by a gearbox assembly removably engageable with one of the plurality of jacks.

In one example, the system further comprises at least one working platform

In one example, at least one connection beam is configured to releasably attach to the working platform.

In one example, the system further comprises a connection element between the horizontal formwork element and at least one connection beam configured for releaseable engagement between the horizontal formwork element and the at least one connection beam.

In one example, the connection element is configured to securedly receive a T-Bolt or a X-Bolt.

In one example, the system further comprises a plurality of vertically aligned side formwork panels configured to confront the concrete structure.

In one example, the system further comprises at least one vertical beam configured to indirectly attach to the concrete bridge pier cap.

In one example, the concrete structure comprises a bridge pier cap.

In one example, the bridge pier cap comprises one of a multi-column cap, a hammerhead, or a straddled cap.

In one example, a first part of the two discrete parts comprises a first connection beam and a first main beam.

In one example, a second part of the two discrete parts comprises at least the horizontal formwork panel with a second connection beam and second main beam.

In one example, the horizontal formwork element is a formwork panel with a formlining.

In one example, the plurality of main beams comprises at least a first main beam and a second main beam, wherein the first main beam is disposed below a first connection beam and the horizontal formwork element and a second main beam is disposed below a second connection beam and the horizontal formwork element.

In one example, the plurality of connection beams and the horizontal formwork are at approximately a same height relative to a horizontal axis when connected.

In one example, a longitudinal axis of at least one of the plurality of connection beams and a longitudinal axis of at least one of the plurality of main beams are substantially parallel along the longitudinal direction.

In one example, an axis in a length direction of the horizontal formwork element and an axis of the connection beams in the longitudinal direction are substantially parallel to each other.

Another aspect of the disclosure provides a method of striking a formwork system, comprising: splitting the formwork system in a longitudinal direction into two discrete parts by releasing a connection between one of a plurality of connection beams and a horizontal formwork element; removing a first discrete part of the formwork system; and removing a second discrete part of the formwork system.

In one example, the first discrete part comprises at least one of the connections beams.

In one example, the first discrete part further comprises a first main beam.

In one example, the second discrete part comprises at least the horizontal formwork and a second connection beam.

In one example, the second discrete part further comprises a second main beam.

In one example, the method further comprises lowering the formwork system vertically before removing the first discrete part of the formwork system and the second discrete part of the formwork system.

In one example, one or more jacks are configured to lower the formwork system.

BRIEF DESCRIPTION OF THE DRAWINGS

The invention description below refers to the accompanying drawings, of which.

DETAILED DESCRIPTION

Figure 1A:
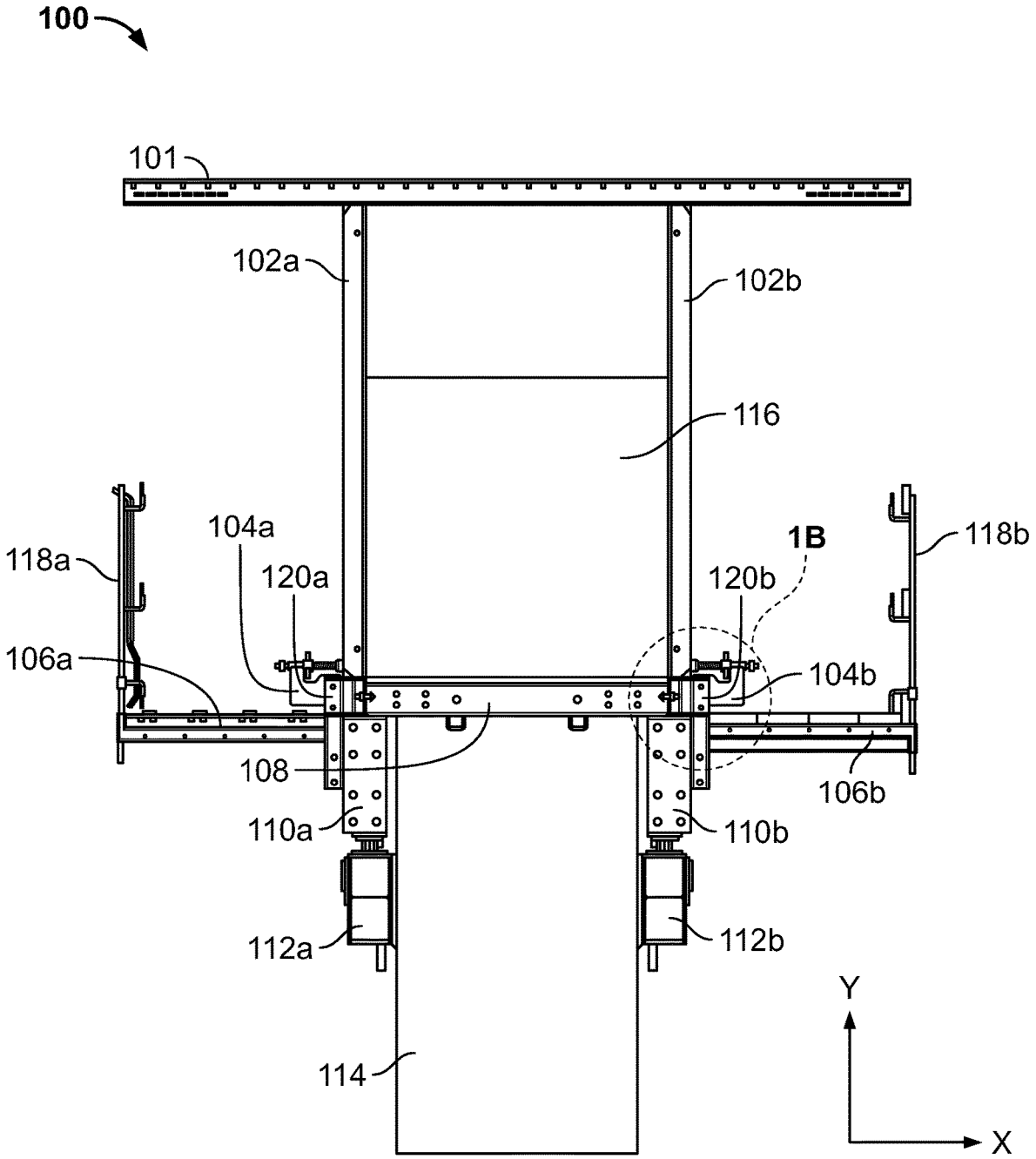
FIG. 1A is side view of a formwork system according to one or more aspects of the disclosure.
Figure 2:
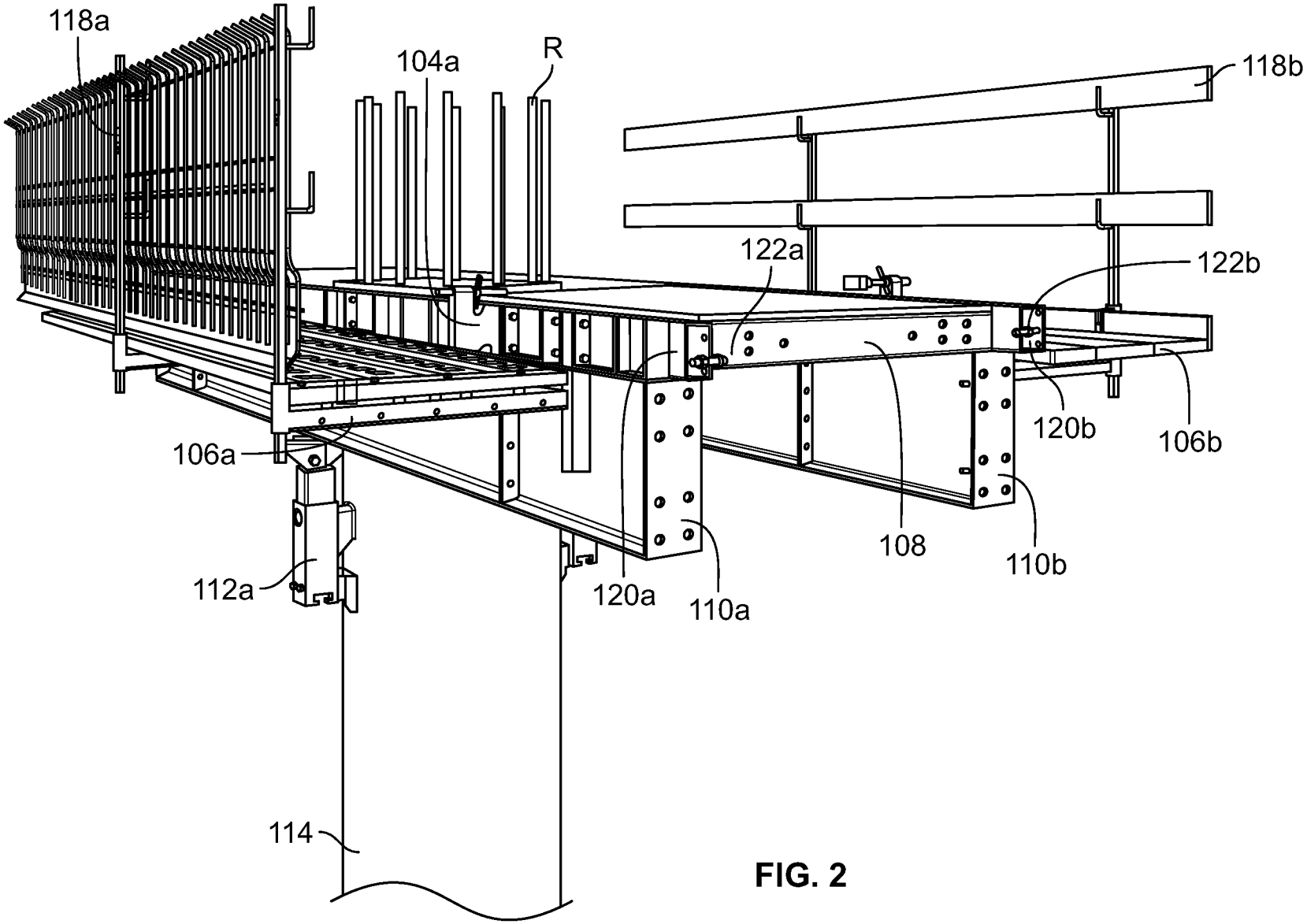
FIG. 2 is a side perspective view of a formwork system according to one or more aspects of the disclosure.

FIG. 1A is side view of a formwork system 100 configured with a sideform assembly according to one or more aspects of the disclosure and FIG. 2 is a side perspective view of a formwork system 100 in a preparation stage for pouring a bridge pier cap.

The formwork system 100 can include a horizontal formwork element 108, respective connection beams 120*a, b*, and main beams 110*a, b*. The main beams 110*a, b* can be supported by respective jacks 112*a, b* with respect to the bridge pier 114, as will be described in greater detail below. The horizontal formwork element 108, respective connection beams 120*a, b*, and main beams 110*a, b* can be formed of any material, such as metal (e.g., steel), wood, a polymer, or any combination thereof. In some examples, the horizontal formwork element 108 can be a formwork panel, such as a soffit panel, and have a top layer of a form liner (e.g., formlining or skin layer). In one example, the horizontal formwork element can be a formwork element according to commonly assigned U.S. patent application Ser. No. 16/988,483, entitled FORMWORK SYSTEM AND METHOD, by Huber et al., filed on Aug. 7, 2020.

As shown in FIGS. 1A and 2, the main beams 110*a, b* can have a length extending in the longitudinal direction (e.g., perpendicular to both the horizontal x direction and the vertical y direction) and can have a height in the vertical y direction greater than a width in the horizontal x direction. The main beams 110*a, b* can be parallel to one another and can be oppositely arranged relative to bridge pier 116. The main beams 110*a, b* can vertically support the respective connection beams 120*a, b*, which can also have a length extending in the longitudinal direction (e.g., perpendicular to both the horizontal x direction and the vertical y direction). Each of the longitudinal axes of the respective main beams 110*a, b* can be parallel to the longitudinal axis of the respective connection beams 120*a, b* in the longitudinal direction. The length of the respective connection beams 120*a, b* can be the same as a length of the main beams 110*a, b* in the longitudinal direction. A width of the respective connection beams 120*a, b* in the horizontal x direction can be the same as a width of the main beams 110*a, b*, but in other examples the widths can be different. An axis of the horizontal formwork element 108 can be substantially parallel to one or both axis or axes of the connection beams 120*a, b* in the longitudinal direction. A height of the horizontal formwork element 108 and one or both of connection beams 120*a, b* can be the same relative to the horizontal direction. As shown in FIG. 1A and FIG. 2, the connection beams 120*a, b* are offset horizontally relative to the main beams 110*a, b*, such that a portion of the respective connection beams 120*a, b* extends beyond an outer edge of the main beams 110*a, b*. The connection beams 120*a, b* can be permanently, semi-permanently, or releasably engaged to the main beams 110*a, b*.

As shown, the main beams 110*a, b* can be disposed below the connection beams 120*a, b* and horizontal formwork element 108 relative to the vertical y direction.

The horizontal formwork element 108 can extend in the longitudinal direction (e.g., perpendicular to both the horizontal x direction and the vertical y direction) and can have a length less than a length of main beams 110*a, b*. In this regard, two horizontal formwork elements 108 can be employed at opposing positions relative to the bridge pier 114 with the bridge pier 114 occupying a space defined between the elements 108. In this regard, a combination of the lengths of the two elements 108 with the bridge pier 114 can combine to have a length in the longitudinal direction approximately equal to a length of main beams 110*a*.

The horizontal formwork element 108 can have a height in the vertical y direction that is the same as a height of the connection beams 120*a, b*. A width of the horizontal formwork element 108 in the horizontal x direction can correspond to a distance between inner surfaces of side formwork elements 102*a, b* and correspond to a width of the bridge pier cap 116 in the horizontal x direction. In some examples, a top surface of the horizontal formwork element 108 can be planar and form a continuous surface with a top surface of bridge pier 114, thereby providing a flat surface for the formation and support of the bridge pier cap.

The length (oriented in longitudinal direction) of the horizontal formwork element 108 can be based on the metric measurement system and the width (oriented in horizontal x direction) of the horizontal formwork element 108 can be based on the imperial or US customary units measurement system or vice versa, or a combination of both. For example, the length of the horizontal formwork element 108 can be an integer multiple of one centimeter (for example, 5 centimeters, 57 centimeters, 96 centimeters, 130 centimeters, etc.) or a multiple of 50 centimeters (for example, 50 centimeters, 100 centimeters, 200 centimeters, etc.). The width of the horizontal formwork element 108 can be an integer multiple of an inch (for example, 1 inch, 2 inches, 10 inches, 47 inches, 98 inches, etc.) or an integer multiple of a foot (for example, 1 foot, 3 feet, 10 feet). Thus the panel can be used in different countries with different measurement systems without modification. Furthermore, the panel can be rotated (so that the length side now corresponds to the width side and vice versa), depending on whether the structure to be concreted (such as the bridge pier head) is aligned according to the metric or the imperial measurement system.

As shown in FIG. 2, the formwork system 100 can include one or more horizontal formwork elements 108 (as can be seen below in FIG. 3H) and can be oppositely arranged forming a gap to allow bridge pier cap 116 to be formed atop the bridge pier 114. In one example, reinforcement elements R can be used to allow bridge pier cap 116 to be concreted integrally with bridge pier 114.

As shown in FIG. 1A, the formwork system 100 can be used to form any type of concrete structure(s), such as bridge pier cap 116. The bridge pier cap 116 can be any type of bridge pier cap, such as a multi-column cap (e.g., cross beam), a hammerhead, or a straddled cap (e.g., straddled bent).

The formwork system 100 can engage with a sideform assembly comprising vertically aligned side formwork elements 102*a, b* (such as formwork panels) and formwork crossbeam 101. The side formwork elements 102*a, b* and horizontal formwork element 108 generally define a volume for receiving poured concrete and hardening of the concrete for forming the bridge pier cap 116. The formwork crossbeam 101, side formwork elements 102*a, b*, and the horizontal formwork element 108 can be formed of any suitable material, such as metal, a polymer, wood, or any combination thereof. The side formwork elements 102*a, b* confront the bridge pier cap 116 by virtue of the pouring and concreting process in forming the bridge pier cap 116. The side formwork elements 102*a, b* can extend in the longitudinal direction and can have a height extending in the vertical direction that is greater than a height of the desired bridge pier cap 116.

The side formwork elements 102*a, b* can be removably engaged with the formwork system 100 by respective connection elements 104*a, b*. In this regard, the connection elements 104*a, b* can respectively extend from and be engaged with connection beams 120*a, b* such that the connection elements 104*a, b* can be disengaged, allowing for the side formwork elements 102*a, b* to be disengaged from the formwork system 100.

The formwork system 100 can include respective working platforms 106*a, b* extending in the horizontal direction that are attached permanently, semi-permanently, or releasably with main beams 110*a, b* and/or connection beams 120*a, b*. The working platforms 106*a, b* can include guardrails 118*a, b* extending in a vertical direction to provide a safe working space for a worker and/or to prevent equipment from falling off the platforms 106*a, b*. The platforms 106*a, b* and the guardrail 118*a, b* can be formed of any suitable material, such as metal, a polymer, wood, or any combination thereof.

Figure 1B:
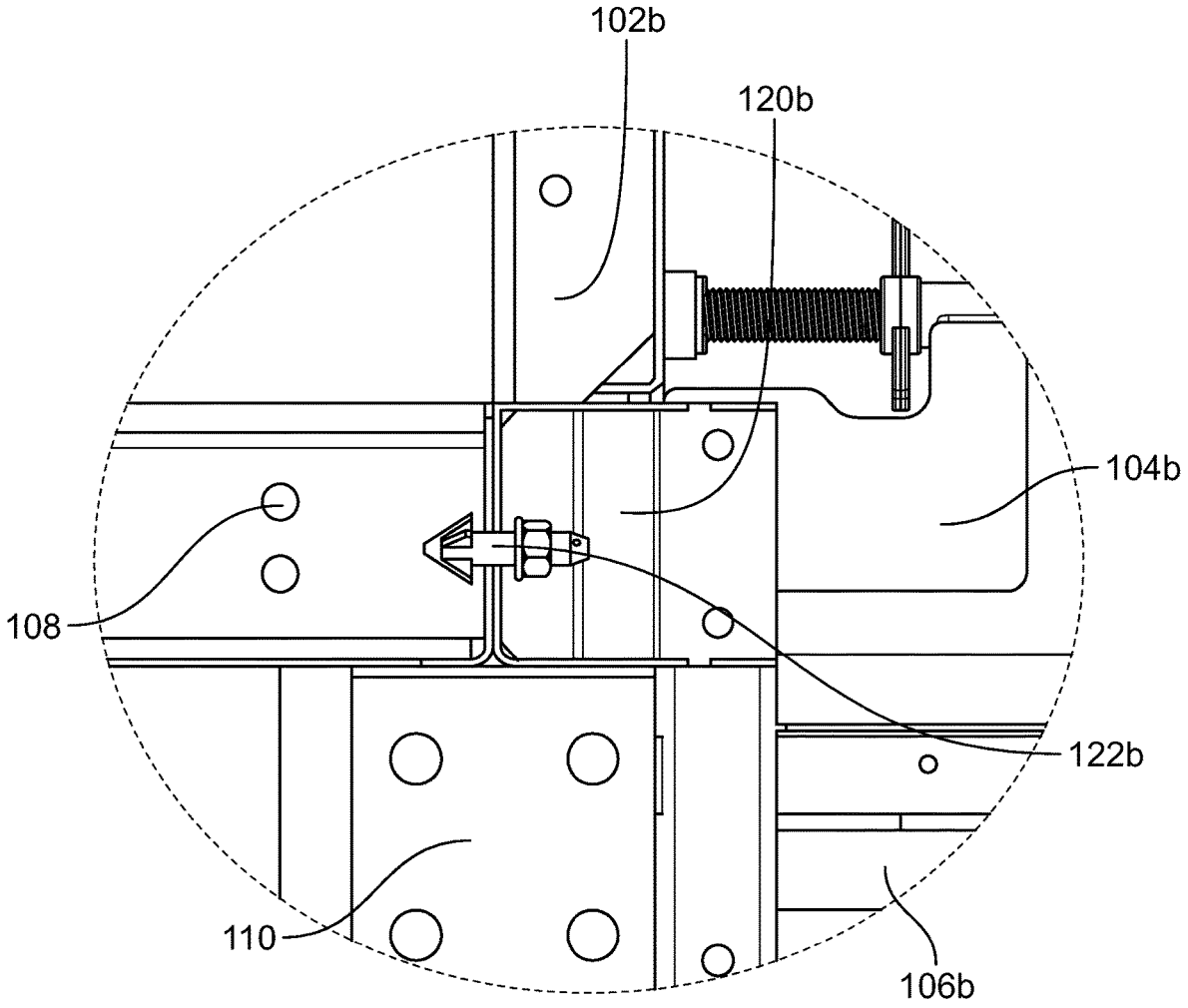
FIG. 1B is an enlarged view of a portion A of the formwork system of FIG. 1A according to one or more aspects of the disclosure.

The horizontal formwork element 108 is releasably attached to both the left-hand connection beam 120*a* and the right-hand connection beam 120*b*, with either or both capable of being detached or disengaged at the same time. In the example of FIGS. 1A-B and 2, the horizontal formwork element 108 is releasably attached (directly or indirectly) to the right-hand connection beam 120*b*, forming an reverse L-shaped arrangement by virtue of the combination of side formwork element 102*b* and horizontal formwork element 108. In other examples, the horizontal formwork element 108 is releasably attached (directly or indirectly) to the left-hand connection beam 120*a*, forming a L-shaped arrangement by virtue of the combination of side formwork element 102*a* and horizontal formwork element 108.

The right-hand connection beam 120*b*, right-hand working platform 106*b* (optionally), right-hand main beam 110*b*, and horizontal formwork element 108 can be stricken, cycled and moved as a single unit by virtue of connection element 122*b* shown in FIG. 1B. In other examples, the working platform 106*b* can be removed individually and separately while.

The formwork system 100 and the components thereof can be supported by bridge pier 114 by virtue of one or more jacks 112*a, b* that are anchored to the bridge pier 114 and support the main beams 110*a, b*.

FIG. 1B is an enlarged view of a portion A of the formwork system of FIG. 1A according to one or more aspects of the disclosure. As shown in FIG. 1B, connection elements 122*a, b* can be integrally formed into the connection beams 120*a, b* and horizontal formwork element 108 allowing for releasable engagement of the beams 120*a, b* and horizontal formwork element 108. The connection elements 122*a, b* define openings for securedly receiving a fixation element, such as an X-bolt (having a bolt head in an X-shape), T-bolt (having a bolt head shape in a T-shape), or any other kind of bolt such that insertion and engagement of the bolt into the defined openings provides secure engagement between the connection beams 120*a, b* and the horizontal formwork element 108. For example, a multi-head bolt could be used as the fixation element, as described in commonly assigned U.S. patent application Ser. No. 16/988,538, entitled MULTI-HEAD BOLT AND FASTENER SYSTEM, by Huber et al., filed on Aug. 7, 2020, the teachings of which are expressly incorporated herein by reference. The horizontal formwork element 108 can be removably engageable at opposing ends with the respective connection beams 120*a, b* by respective connection elements 122*a, b*, which can be independently disengaged.

Figure 1C:
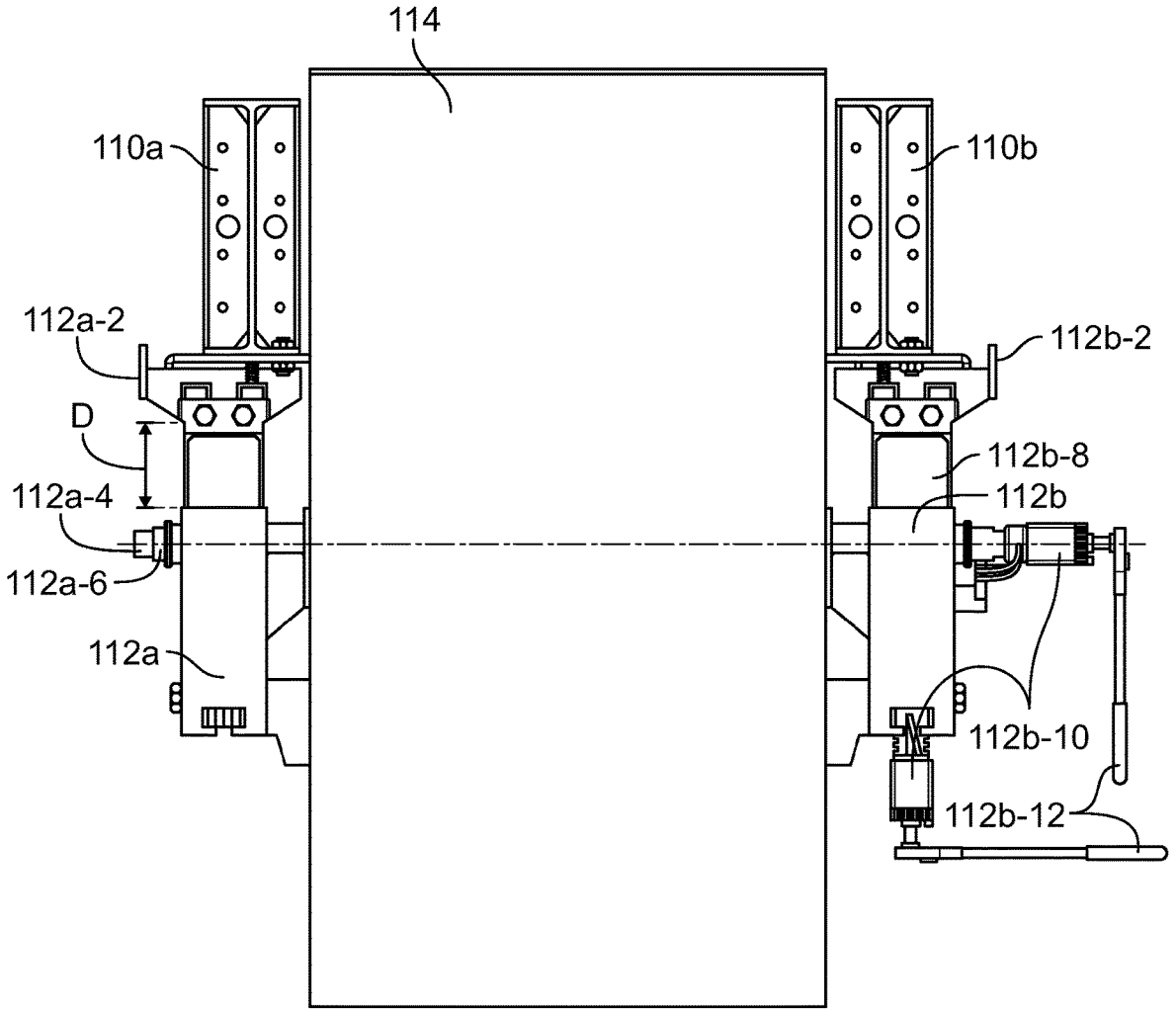
FIG. 1C is a view of the formwork system of FIG. 1A showing the operation of one or more jacks according to one or more aspects of the disclosure.

FIG. 1C is a view of the formwork system of FIG. 1A showing the operation of one or more jacks according to one or more aspects of the disclosure.

As shown, the jacks 112*a, b* are configured to support main beams 110*a, b* during pouring and hardening of bridge pier cap 116. The jack 112*a* can include a head bearing 112*a*-2 that can directly or indirectly confront the main beam 110*a*. The jack 112*a* can be affixed to bridge pier 114 by tie rod 112*a*-4 and nut 112*a*-6 in a removably engageable manner.

In FIG. 1C, jacks 112*a, b* can be identical, with jack 112*b* having a head bearing 112*b*-2, and being fixed to bridge pier 114 by a tie rod (not shown) and nut (not shown). In this example, jack 112*b* is engaged with a gearbox assembly 112*b*-10 engageable with one or more ratchet or screwdriver elements 112*b*-12. In this regard, the jack 112*b* includes a telescoping cylinder 112*b*-8 that moves vertically and can be raised or lowered by virtue of gearbox assembly 112*b*-10 that cooperates with a built-in gearbox assembly onboard the jacks 112*a, b* (not shown) when the gearbox assembly 112*b*-10 is actuated by ratchet or screwdriver elements 112*b*-12. The gearbox assembly 112*b*-10 can have a first gear ratio and the built-in gearbox assembly of the jack 112*b* has a second gear ratio such that vertical motion of the telescoping cylinder 112*b*-8 is easier and faster. For example, rotation of the ratchet or screwdriver elements 112*b*-12 can result in actuation of the gearbox assembly

112*b*-10, which in turn causes vertical movement of telescoping cylinder 112*b*-8. This causes vertical movement of head bearing 112*b*-2 and thus vertical movement of main beams 110*a* and other elements of the formwork system. Each of the jacks 112*a, b* can be engageable with a gearbox assembly (e.g., 112*b*-10) and can be vertically adjusted (e.g., by up to a distance D) simultaneously or independently from one another.

FIGS. 3A-3H depict side and perspective side views of a formwork system in various stages of striking and/or cycling according to one or more aspects of the disclosure.

Figure 3A:
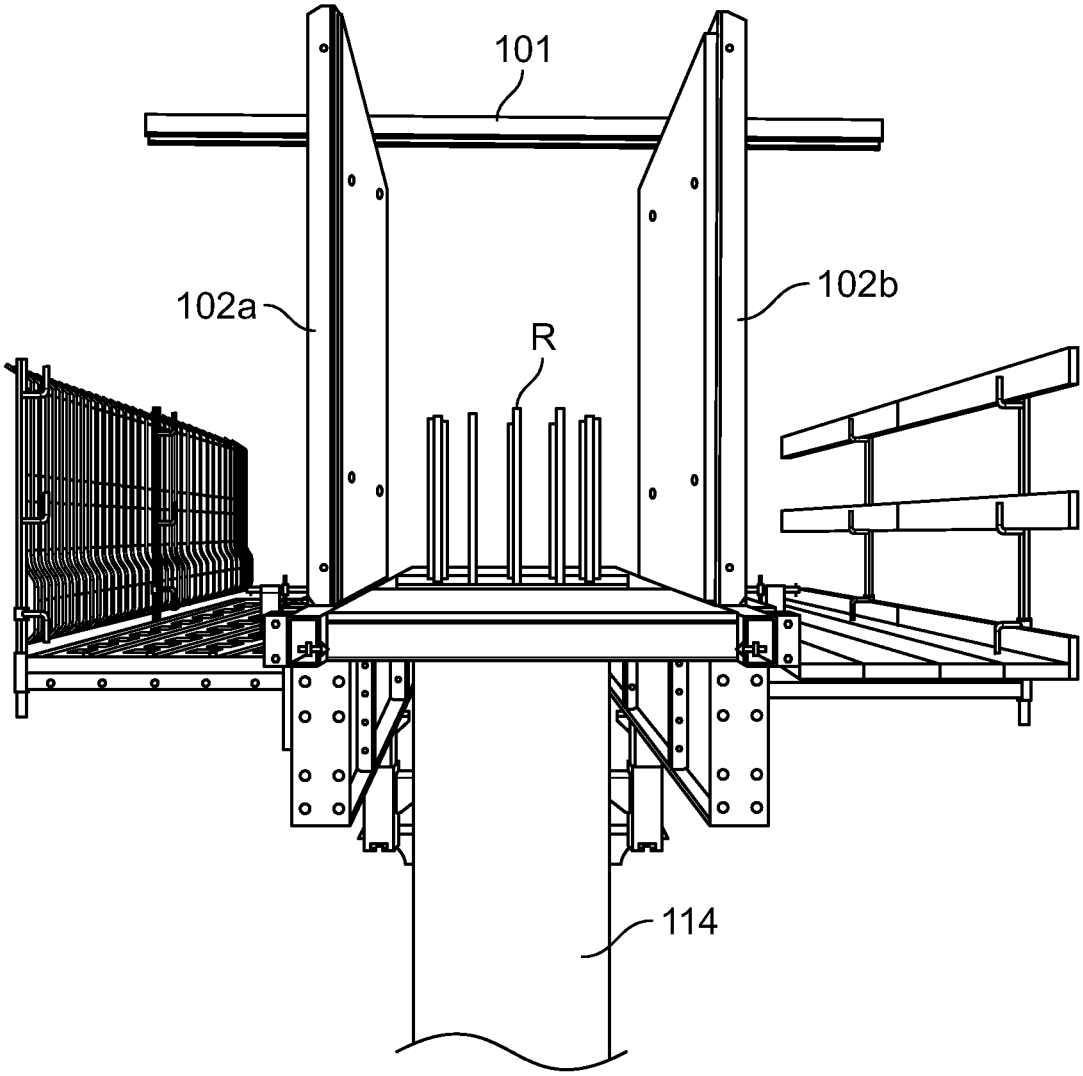
FIGS. 3A-3H depict various stages of striking and/or cycling a formwork system according to one or more aspects of the disclosure.

FIG. 3A depicts the formwork system 100 engaged with a sideform assembly including side formwork elements 102*a, b* and formwork crossbeam 101. In this stage, reinforcement elements R are vertically exposed in preparation for pouring concrete and forming bridge pier cap 116.

Figure 3B:
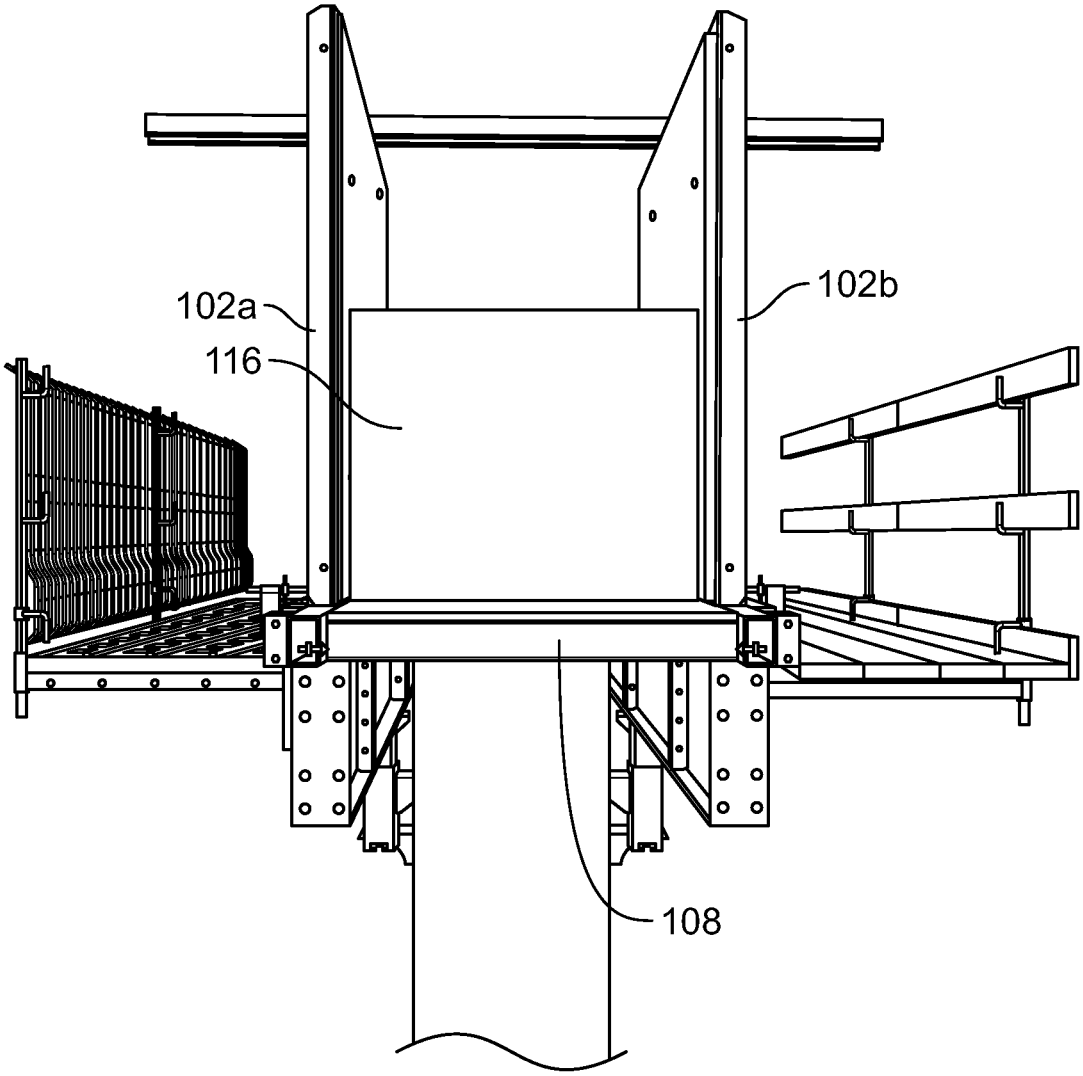

FIG. 3B depicts a formwork system 100 engaged with side formwork elements 102*a, b* and formwork crossbeam 101. In this stage, the bridge pier cap 116 has been poured and allowed to dry/form as a concrete structure in the volume defined at least partially between elements 102*a, b* and horizontal formwork element 108. The drying can occur for some time after pouring. Once the concrete is formed, cycling can begin as described below.

Figure 3C:
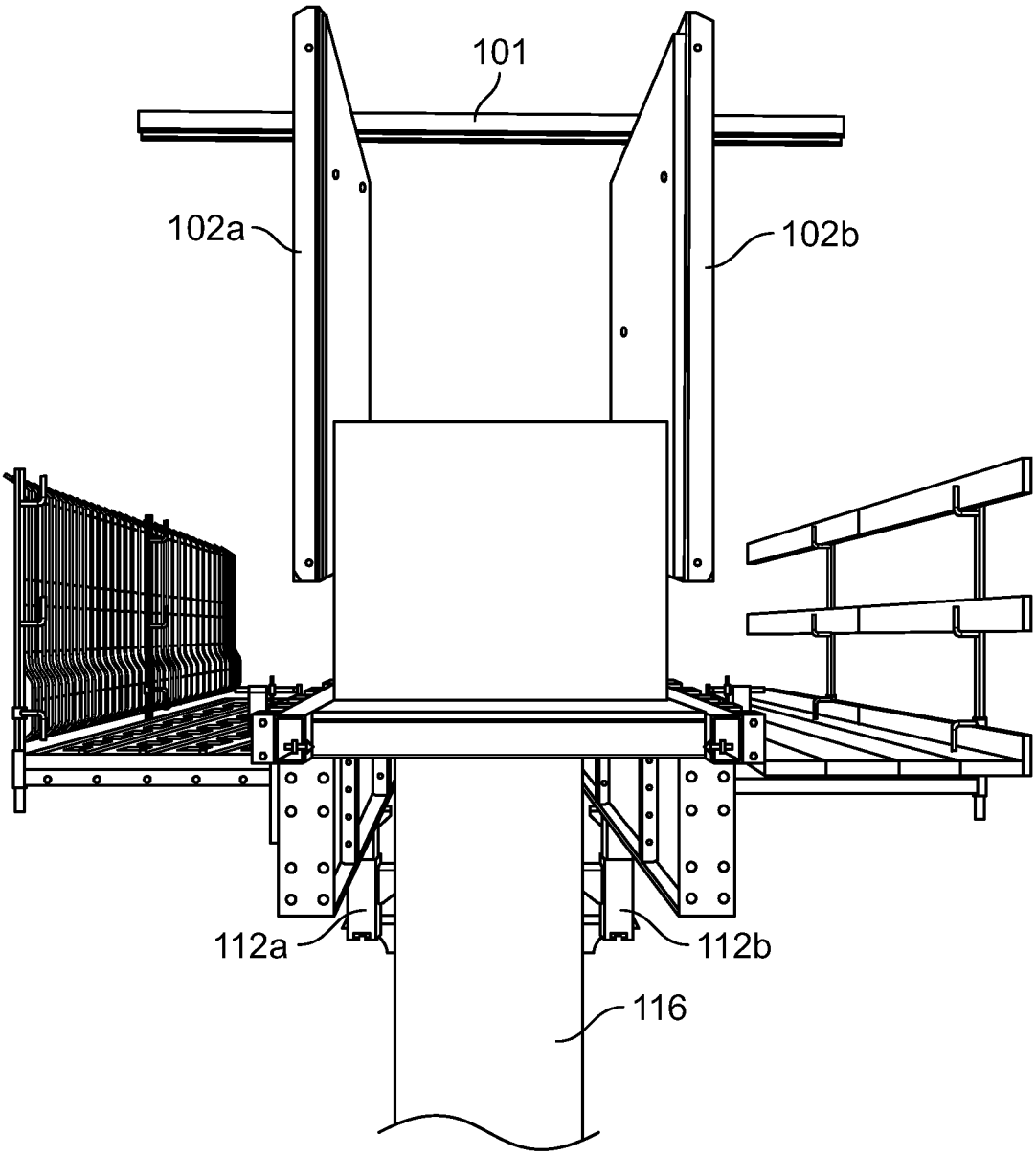

In FIG. 3C, the formwork element 102*a, b* (and formwork cross beam 101) have been stricken (e.g. removed) from the bridge pier cap 116 for example via a crane. Once removed, cycling and/or striking of the formwork system 100 can commence as described in greater detail below.

Figure 3D:
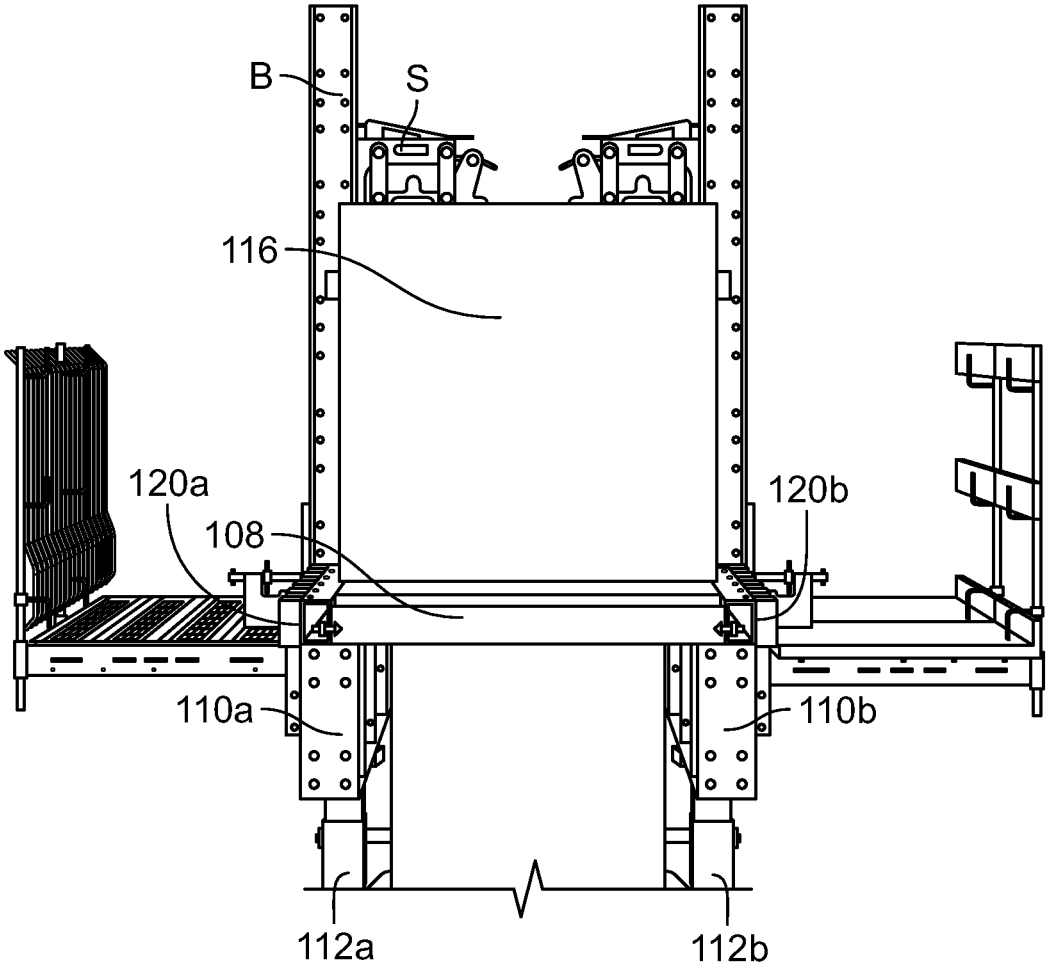

In FIG. 3D, the jacks 112*a, b* are lowered in connection with striking the side formwork panels 102*a, b* from the bridge pier cap 116 and two vertical beams (B) were respectively fixed to the connection beams 120*a, b* and attached to the concreted bridge pier head via two striking tools(S). For example, a gearbox assembly (such as gearbox assembly 112*b*-10 described above) can be engaged with the one or more of the jacks 112*a, b* and allow for a downward vertical motion of a head bearing and a resulting downward motion of main beams 110*a, b*. This provides a corresponding downward vertical motion of horizontal formwork element 108, connection beams 120*a, b* and allows for striking/removal of the horizontal formwork element 108 from the bridge pier cap 116. As shown, vertical beam B confronts and is indirectly attached with the bridge pier cap 116 by striking tool S and can be stricken from the bridge pier cap 116 by one or more striking tools S which can cause the horizontal formwork element 108 and connection beams 120*a, b* as well as the main beams 110*a*, 110*b* to be retract slightly away from the bridge pier cap 116. In one example, a striking tool can be used, such as the striking tool described in commonly assigned U.S. patent application Ser. No. 16/988,492, entitled STRIKING TOOL AND METHOD, by Huber et al., filed on Aug. 7, 2020, the teachings of which are expressly incorporated herein by reference.

Figure 3E:
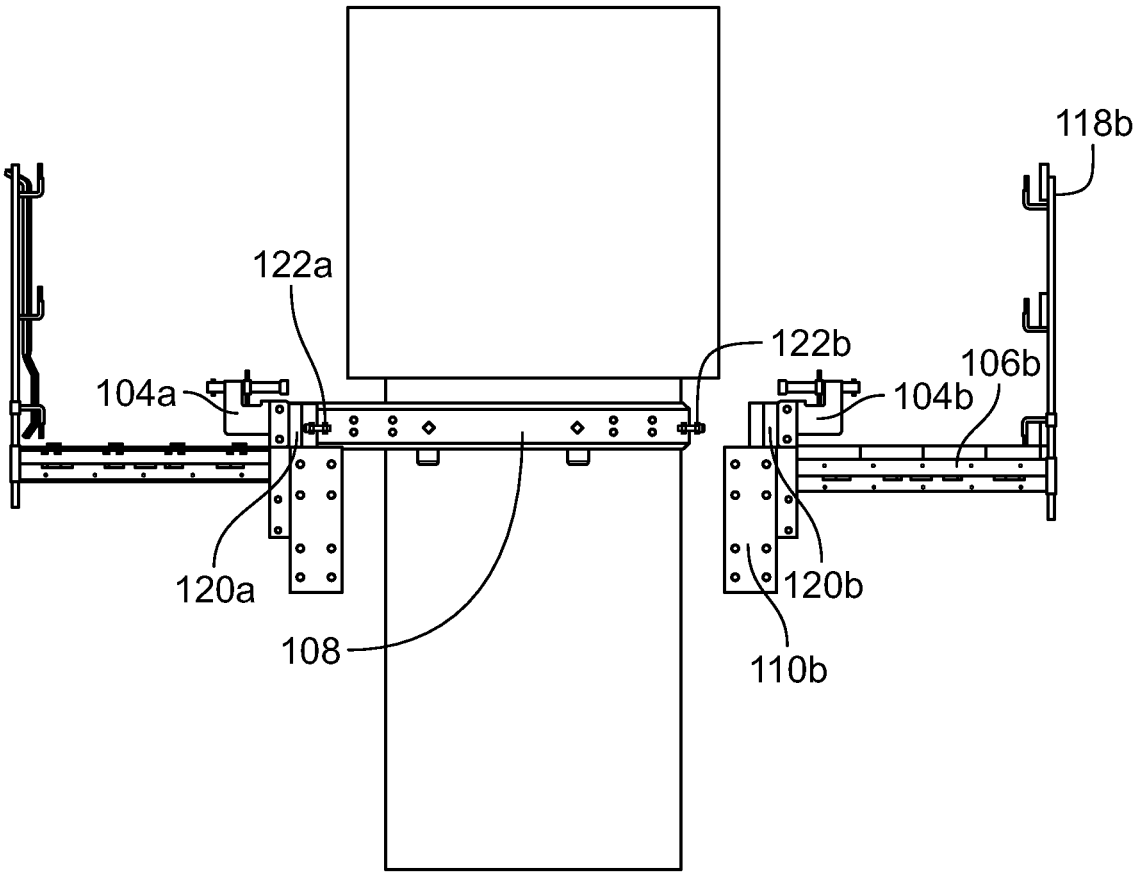
Figure 3F:
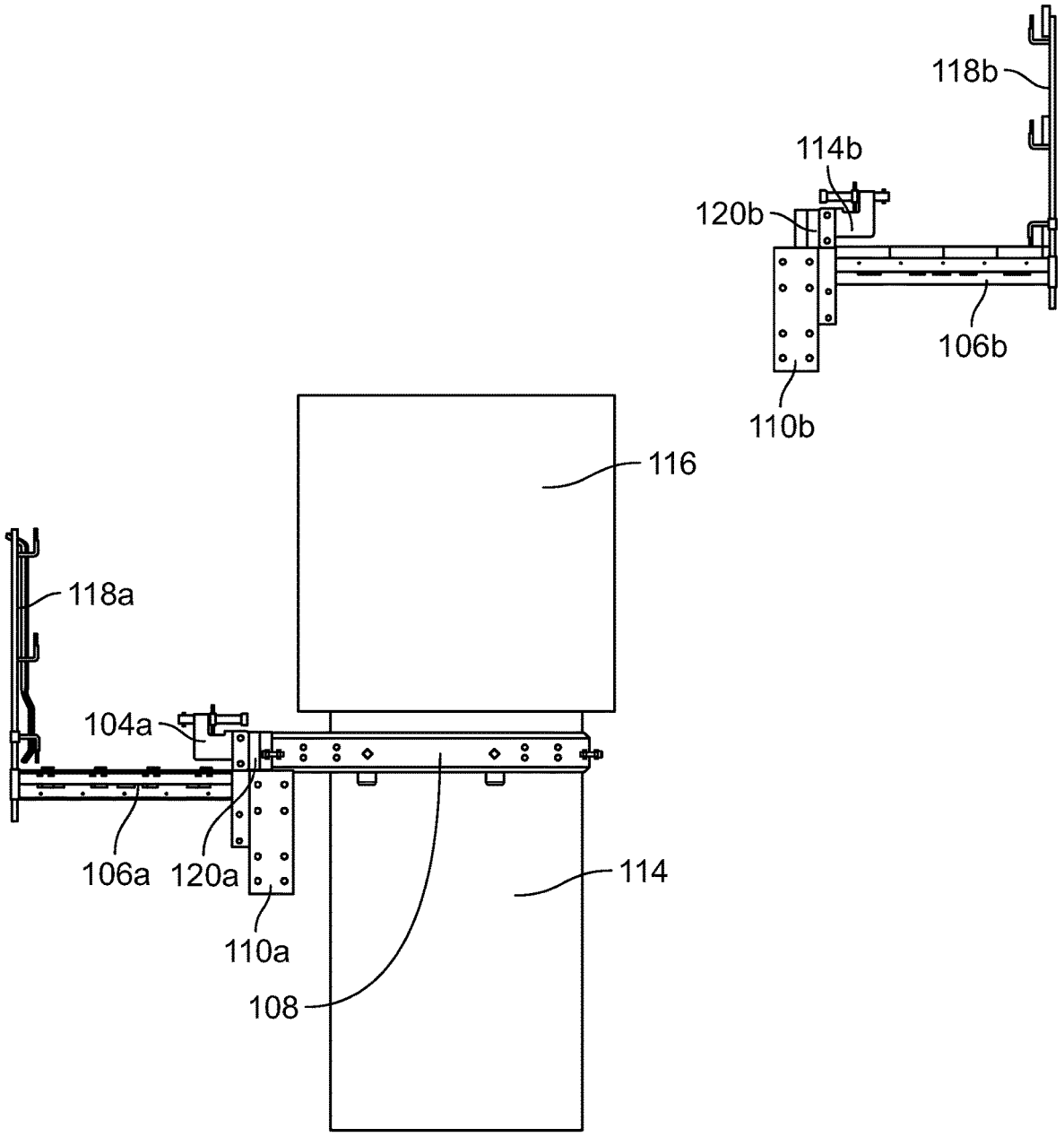

In FIGS. 3E-F, the connection element 122*b* has been disengaged (while the connection element 122*a* remains engaged), allowing horizontal formwork element 108 to be separated and disengaged from main beam 110*b* and connection beam 120*b*. As shown, the connection beam 120*b*, main beam 110*b*, working platform 106*b*, connection element 104*b*, and guiderail 118*b* can be removed as a first single discrete unit, such as by a crane. As shown in FIG. 3E, the first of two discrete units can be stricken or striked by a striking mechanism, resulting in a longitudinal split of the formwork system 100 generally along the longitudinal direction. Once stricken, the first discrete part can then transported by crane as shown in FIG. 3F, leaving behind the second discrete part relative to the bridge pier cap 116. The second discrete part, for example, can already be attached to a crane or held in place on the bridge pier cap 116 via vertical beam B and striking tool S. In FIG. 3E, the first discrete unit can include at least main beam 110*b*, and connection beam 120*b* and optionally working platform 106*b* and guardrail 118*b*. In one example, the first discrete unit can include connection beam 120*b* or can include connection beam 120*b* and main beam 110*b*. In a further example, the first discrete unit can optionally further include one or more of elements 106*b*, 104*b*, and 118*b*, while in other examples one or more of elements 104*b*, 106*b*, and/or 118*b* can be removed as further discrete parts.

Figure 3G:
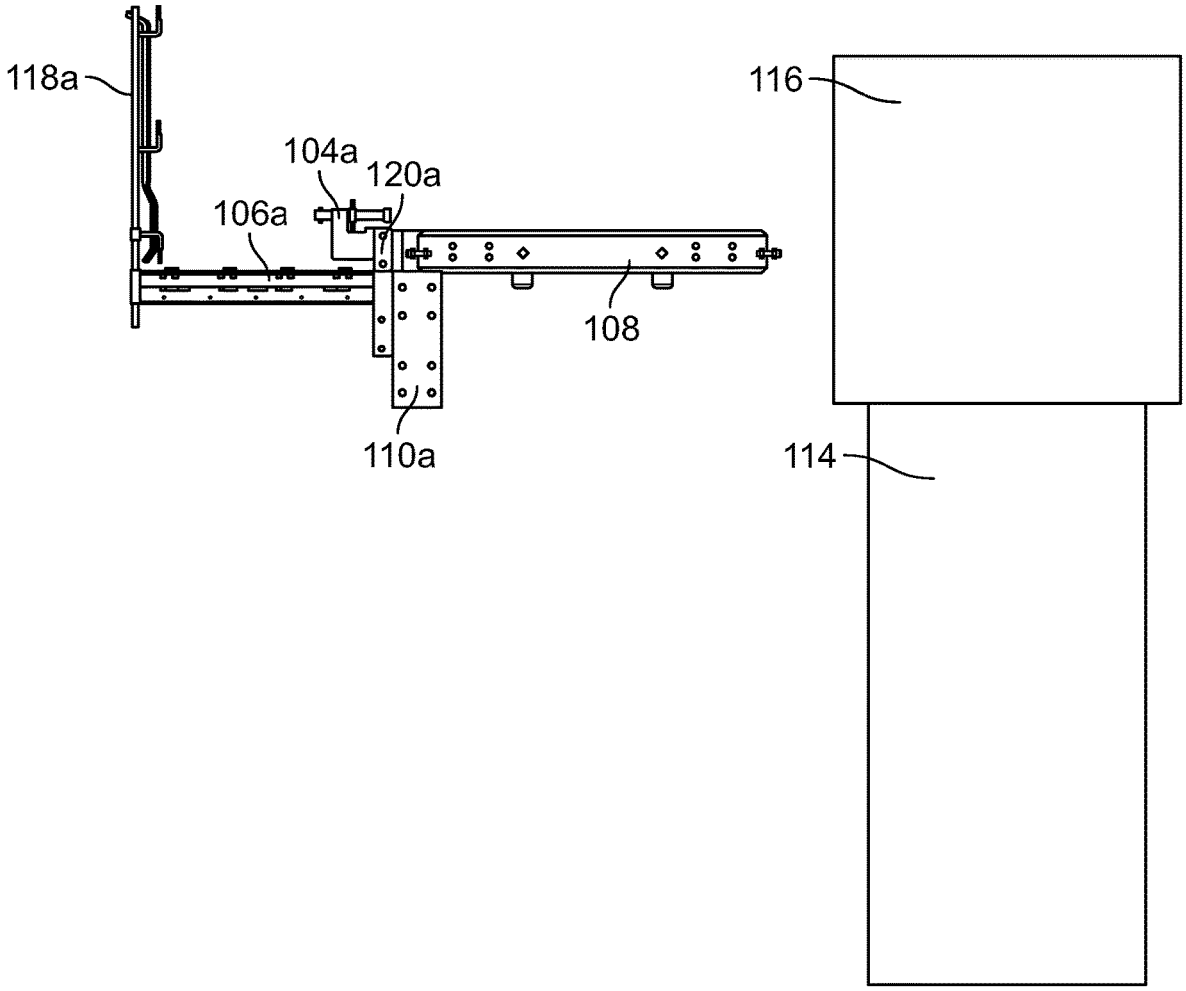

In FIGS. 3F-G, at least some or all of the remaining elements can be removed from the bridge pier cap as a second discrete single unit. As shown in FIG. 3F, the second of two discrete units can be removed by a second crane (or using the first crane a second time). In FIG. 2E, the second discrete unit can include horizontal formwork element 108, working platform 106*a*, horizontal formwork 110*a*, connection element 104*a*, connection beam 120*a*, and guiderail 118*b*. In one example, the second discrete unit can include horizontal formwork element 108 and connection beam 120*a*. In another example, the second discrete unit can include at least horizontal formwork element 108, main beam 110*a*, and connection beam 120*a*. In a further example, the second discrete unit can optionally further include one or more of elements 104*a*, 106*a*, 118*a*, while in other examples one or more of elements 104*a*, 106*a*, and/or 118*a* can be removed as further discrete parts. Advantageously, the formwork system is split in the longitudinal direction (e.g., along the longitudinal axis) into two discrete parts the assembly can be removed in two steps as two discrete units to reduce cycling time, where they can be assembled to an additional bridge pier for formation of additional bridge pier caps.

Figure 3H:
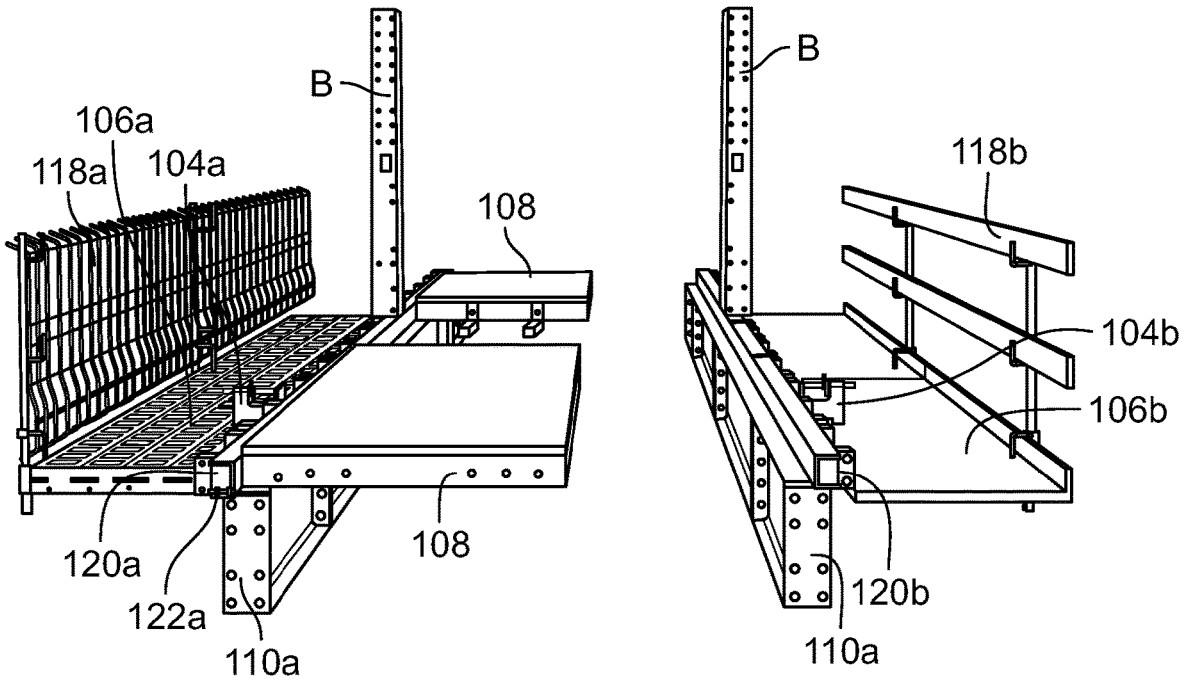

In FIG. 3H, the two discrete parts can be attached to a second bridge pier for formation of an additional bridge pier cap, restarting the concrete formation and cycling process.

While the stages of FIGS. 3A-H depict disengagement of connection element 122*b*, it is contemplated that instead connection element 122*a* can be disengaged, allowing for the horizontal formwork element 108 to be part of a discrete unit with connection beam 120*b*, or with connection beam 120*b* and main beam 110*b* together, or either of the previous examples together with working platform 106*b* and/or guardrail 118*b*.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A formwork system, comprising:

at least one horizontal formwork element configured to support a concrete structure;

a first connection beam having an integrally formed first connection element and being releasably connected to the horizontal formwork element via a first fixation element received by the first connection element; a second connection beam having an integrally formed second connection element and being releasably connected to the horizontal formwork element via a second fixation element received by the second connection element such that, upon disengagement of one of the first fixation element or the second fixation element, the formwork system is configured to split in a longitudinal direction and stricken or cycled from the concrete structure in two or more discrete parts; and a plurality of main beams configured to support the at least one horizontal formwork element, the first connection beam, and the second connection beam.

2. The formwork system of claim 1, wherein at least one of the plurality of main beams is releasably connected to at least one of the first connection beam or the second connection beam.

3. The formwork system of claim 1, further comprising a plurality of jacks fixed to a bridge pier configured to a least partially support the plurality of main beams, wherein the plurality of jacks, upon actuation, cause respective vertical displacement of the plurality of main beams.

4. The formwork system of claim 1, wherein at least one of the first fixation element or the second fixation element is a bolt.

5. The formwork system of claim 1, further comprising at least one vertical beam configured to indirectly attach to the concrete structure, and wherein the concrete structure comprises a bridge pier cap.

6. The formwork system of claim 1, wherein a first part of the two discrete parts comprises the first connection beam and a first main beam of the plurality of main beams.

7. The formwork system of claim 6, wherein a second part of the two discrete parts comprises at least the horizontal formwork panel, the second connection beam and a second main beam of the plurality of main beams.

8. The formwork system of claim 7, wherein the first main beam is disposed below the first connection beam and the horizontal formwork element, and the second main beam is disposed below the second connection beam and the horizontal formwork element.

9. A formwork system, comprising:

at least one horizontal formwork element configured to support a concrete structure;

at least one connection beam having an integrally formed connection element and being releasably connected to the at least one horizontal formwork element via a fixation element received by the connection element such that, upon disengagement of the fixation element, the formwork system is configured to split in a longitudinal direction and stricken or cycled from the concrete structure in two or more discrete parts; and a plurality of main beams configured to support the at least one horizontal formwork element and the at least one connection beam.

10. The formwork system of claim 9, further comprising a plurality of jacks fixed to a bridge pier configured to a least partially support the plurality of main beams, wherein the plurality of jacks, upon actuation, cause respective vertical displacement of the plurality of main beams.

11. The formwork system of claim 9, wherein the fixation element is a bolt.

12. The formwork system of claim 9, further comprising at least one vertical beam configured to indirectly attach to the concrete structure, and wherein the concrete structure comprises a bridge pier cap.

13. The formwork system of claim 9, wherein the at least one connection beam comprises a plurality of connection beams.

14. The formwork system of claim 13, wherein at least one of the plurality of main beams is releasably connected to at least one of the plurality of connection beams.

15. The formwork system of claim 13, wherein a first part of the two discrete parts comprises a first connection beam of the plurality of connection beams and a first main beam of the plurality of main beams.

16. The formwork system of claim 15, wherein a second part of the two discrete parts comprises at least the horizontal formwork panel, a second connection beam of the plurality of connection beams and a second main beam of the plurality of main beams.

17. The formwork system of claim 16, wherein the first main beam is disposed below the first connection beam and the horizontal formwork element, and the second main beam is disposed below the second connection beam and the horizontal formwork element.

18. A system, comprising:

a formwork system, including:

at least one horizontal formwork element configured to support a concrete structure, at least one connection beam having an integrally formed first connection element and being releasably connected to the horizontal formwork element via a fixation element received by the connection element such that, upon disengagement of the fixation element, the formwork system is configured to split in a longitudinal direction and stricken or cycled from the concrete structure in two or more discrete parts, and a plurality of main beams configured to support the at least one horizontal formwork element and the at least one connection beam; and a sideform assembly including a plurality of side formwork elements, the side formwork elements and horizontal formwork element defining a volume for receiving poured concrete, the sideform assembly removably engagable with the formwork system.

19. The formwork system of claim 18, wherein the at least one connection beam comprises a plurality of connection beams.

* * * * *